United States Patent [19]

Goyert et al.

[11] Patent Number: 4,754,536

[45] Date of Patent: Jul. 5, 1988

[54] APPARATUS AND METHOD FOR CONNECTORS OF VARYING DIMENSIONS

[75] Inventors: Josita M. Goyert, Elizabethtown; Daniel B. Grubb, Hummelstown; Richard L. Schaeffer, Carlisle; Joseph F. Stachura, Palmyra, all of Pa.

[73] Assignee: AMP Incorporated, Harrisburg, Pa.

[21] Appl. No.: 945,588

[22] Filed: Dec. 23, 1986

[51] Int. Cl.[4] ..... H01R 43/04

[52] U.S. Cl. ..... 29/33 M; 29/564.1; 29/748

[58] Field of Search ..... 29/33 M, 564.1, 564.4, 29/564.6, 564.7, 564.8, 566.2, 749, 748, 751, 753, 857, 861, 866

[56] References Cited

U.S. PATENT DOCUMENTS

| | | | |
|---|---|---|---|
| 2,765,468 | 10/1956 | Cootes et al. | 29/566.2 |
| 3,386,153 | 6/1968 | Lau et al. . | |
| 3,481,018 | 12/1969 | Kerkhof | 29/753 X |
| 3,659,328 | 5/1972 | Klein | 29/564.1 X |
| 4,525,927 | 7/1985 | Guerout et al. | 29/749 X |
| 4,590,650 | 5/1986 | Brown et al. | 29/564.6 X |

OTHER PUBLICATIONS

AMP-O-Lectric, Model C, Instruction Manual, Copyright 1953, entire brochure (see particularly p. 14).

AMP MTA Termination Station, CM 5685, Rev. A, Jun. 1987, entire brochure.

AMP Operating Instructions A1 8007, Rev. 4/5/68, p. 1.

AMP Instruction Sheet 8008, Mar. 1967, entire brochure.

AMP Applicator Instruction 8012, 11/15/74, entire brochure.

AMP Applicator Instruction A1 8014, 11/15/74, entire brochure.

AMP Applicator Instruction A1 8030, Rev. 3/9/73, entire brochure.

AMP Applicator Instruction A1 8039, 8/30/74, entire brochure.

*Primary Examiner*—Z. R. Bilinsky

*Attorney, Agent, or Firm*—Thomas G. Terrell; William B. Noll

[57] ABSTRACT

The present invention relates to a method through which a machine is enabled to feed a preloaded electrical connector (10) on appropriate spacings to allow the termination of individual wires (W) in terminals (13) in the connector through a novel indexing feed finger (120) which is capable of engaging surfaces (A-E) on the connector which are different relative to a constant indexing stroke. The indexing finger includes surfaces (126–132) capable of handling more than one set of dimensions of more than one style of connector without adjustment. The invention further includes a mechanism (180) for bending a scored portion of terminals to effect a later removal of the terminal carrier strips.

8 Claims, 7 Drawing Sheets

APPARATUS AND METHOD FOR CONNECTORS OF VARYING DIMENSIONS

This invention relates to a method and apparatus for handling electrical connectors of the type which are provided in a family of connectors having numerous positions for terminals which are preloaded into plastic housings to form an assembly. The method and apparatus of the invention involve feeding and indexing of the connector housings, termination of wires within the terminals thereof sequentially, and loading said terminals after termination into the housings while at the same time effecting a bending of the carrier strip which connects the terminals together.

BACKGROUND OF THE INVENTION

The present invention deals with an electrical connector of a type which is provided in a form which embraces an electrical terminal having a front end adapted to mate with a further terminal such as a post and a rear end adapted to be terminated to an insulated electrical wire, the terminated terminal being inserted into a plastic housing which serves to insulate the terminal from surrounding terminals and the conductive elements of circuits and components. The connector involved typically comes in a family wherein the connector housing may accommodate 2, 4, 6, 8 or as many as 30 or more terminals in separate cavities in plastic housings which have an appropriate number of terminal positions. This means automatically that the housings of the connector family are of different dimensions as related to the number of positions involved, 2, 4, 6, 8 and so forth. In the particular situation here involved, the matter is complicated by virtue of the fact that the connector family, in addition to having multiple positions, comes in more than one style with the dimensions of the two styles adding a second and perhaps a third set of dimensions which have to be dealt with. As a general rule, when connectors of the foregoing type are handled by individual operators, the operator performs the function of adjusting the tooling in accordance with the dimensions of the connector and terminal involved. In the present case, the invention embraces an operator assist machine which itself indexes and fixtures the connector preparatory to wire termination, assists in the termination of the wire in the terminal, and feeds the connector out from under the terminating tooling. As can be appreciated with indexing and feeding mechanisms having fixed displacement motions and dimensioned parts, it is usually necessary for an operator to physically make adjustments as between connectors of differently numbered positions or dimensions and particularly, with respect to connectors of different physical shapes. This creates a need frequently for a readjustment or fine tuning of the machine, all of which takes time and particularly skilled labor and in general, results in a lower productivity than if such can be accommodated without the need for adjustments as between connectors of different positions or dimensions.

A second aspect of the invention relates to maintaining the dimensional integrity of terminals and housing elements to allow a precision termination in an assembly of parts which must be eventually fitted together but which initially must allow access to a portion of the terminal for termination which portion is subsequently covered over by the housing of the connector. This problem is exacerbated when the critical elements of the connector housing and terminal are quite small, the center-to-center spacings are also quite small and the practical tolerances of parts have to be made consistent with mass production and low cost of units to meet market demands. In this regard, it has been found useful to provide assemblies of terminals having the carrier strips formed of the metal from which the terminals are made, left attached to thus hold the terminals on the center-to-center spacings as carried in the dies of manufacture, the source of very tight tolerances indeed when compared with single loose piece terminals.

This practice leaves the carrier strip attached until a time after the terminals have been terminated to electrical wires and requires that the carrier strip be removed therefrom so that the individual terminals will be individually isolated in an electrical sense. Additionally, the terminals have to be loaded into their respective cavities or passages within the housings of the connector, again calling for certain dimensional integrity in terms of the relative position of portions of the terminals and portions of the housing, wires terminated in the terminals, all of which is difficult to control without, in normal cases, machines of substantial complexity, tight tolerances and numerous facilities for adjustment of engaging surfaces. A further problem with assemblies of the type just discussed has to do with the removal of the carrier strip following termination and in conjunction with the insertion of the terminals into the housing.

The background to appreciate is one of dealing with very small metal and plastic parts made to have tolerances as wide open as possible and at the same time providing an operator assist machine and method for handling such assemblies of housings and terminals without undue complexity or need for constant tuning and adjustments, all of which lead to poor productivity. As can be appreciated by those skilled in the machine arts, the provision of parts to be worked upon or assembled wherein the parts are of constant and fixed dimension, tightly controlled, vastly simplifies machine design, construction, and maintenance. On the other hand, variation in dimensions either caused by loose tolerances associated with lower costs or dimensional variations deliberately designed into the part or parts for whatever reasons, including as in the present case, a desire to accommodate connectors having a widely varying number of terminal positions as well as connectors having different exterior designs creates a difficult problem.

SUMMARY OF THE INVENTION

This invention relates a method and a machine which accommodates connectors having a relatively large number of positions with varying dimensions and styles, the connectors being of the type wherein electrical terminals are partially preloaded into connector housings to form an assembly. The machine serves to index the connectors to provide alignment for termination of the connector terminals to conductor wires through the use of a novel pawl structure capable of accommodating to the differently arranged exterior surfaces of the housings while effecting an incremental displacement of such connectors which is constant throughout the range of numbers of positions and styles of the connector housings. It does this by providing a series of steps on the end of the pawl feed finger and biasing such feed finger downwardly to "find" the proper or available surface of the connector housing. This indexing allows a precision termination to the terminal of a conductor wire loaded therein by an operator with the terminal during termination being dimensionally altered to allow for its insertion into a connector housing by deforming portions of the terminal inwardly to clear housing surfaces. The machine and method of the invention further embrace a second aspect wherein the terminals of the connector, after termination, are fully seated within the housing by a machine compression stroke, with the driving surface of the machine having an angular disposition which biases a carrier strip interconnecting all the terminals of the connector to buckle and bend in a way allowing its subsequent removal by breaking following complete loading of the terminals into the connector housing. The foregoing is achieved through simplified motor driven mechanisms capable of repeated utilization with minimum adjustment.

DETAILED DESCRIPTION OF THE INVENTION

Figure 1A:
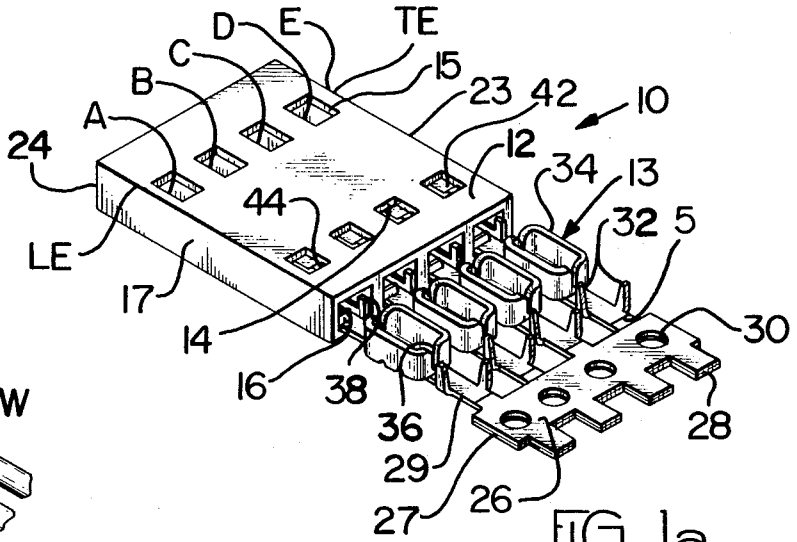
FIG. 1*a* is a perspective view of a four position connector including a housing and four terminals partially preloaded therein.
Figure 1B:
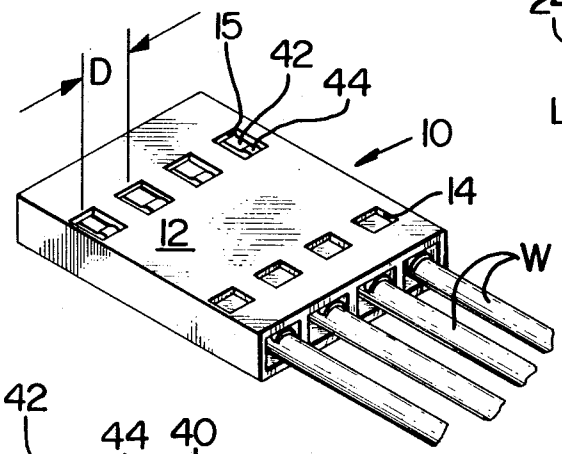
FIG. 1*b* is a view similar to that of FIG. 1*a* with the terminals terminated to conductor wires and completely inserted within the connector housing.

Referring now to FIG. 1*a*, a connector 10 of a type chosen to illustrate the invention has four positions to accommodate four in-line electrical terminals. It is to be understood that the connector 10 is a member of a family which has terminal positions ranging from 2 up to as many as 30 which are generally furnished in multiples of two, although insofar as the invention is concerned, can have odd numbers of positions as well. The connector 10 includes a housing 12 molded of plastic dielectric material, a wide variety of such materials of suitable electrical grade being commercially available in the form of "engineering" plastics. Connector 10 further includes terminals 13 which fit within the housing 12 following termination to electrical wire conductors as is depicted in FIG. 1*b*.

The connector housing 12 is accordingly supplied with a series of spaced apertures 14 and 15 in the top wall thereof, two distinct rows of apertures which serve a terminal latching function to be hereinafter described. The top wall apertures shown toward the front of the connector have vertical surfaces that are to provide an indexing function. The front face of the connector housing 12 contains a series of four apertures not shown, in communication with respective passages 16 in housing 1 in FIG. 1*a*. The terminals 13 for connector 10 are, in the embodiment of FIG. 1*a*, stamped and formed of conductive material having spring qualities such as phosphor bronze of an appropriate hardness to include a variety of details. Reference is made to U.S. Pat. No. 4,435,035 for a teaching as to terminals of the type of those shown in this application.

These terminals are as shown in FIG. 1*a* connected to carrier strips 26 and 27, overlapped to place the terminals which extend therefrom in an alternating arrangement to provide a constant spacing of terminals much closer together than the flat geometries would otherwise allow. The carrier strips include a series of projections 28 and a series of apertures 30 which are aligned in the top and bottom portions of the carrier strips and serve as indexing holes for feeding the terminals during an initial stamping and forming thereof and subsequently, for feeding the terminals in plating and assembly operations. Each of the terminals 13 is connected to the carrier strip by a bridging section 29 relative to the upper carrier strip 26 and each of these sections has a score S which permits a ready bending of the section and relatively clean break following bending for removal of the carrier strips after termination and loading, such removal leaving the connector as it appears in FIG. 1*b*.

Figure 1C:
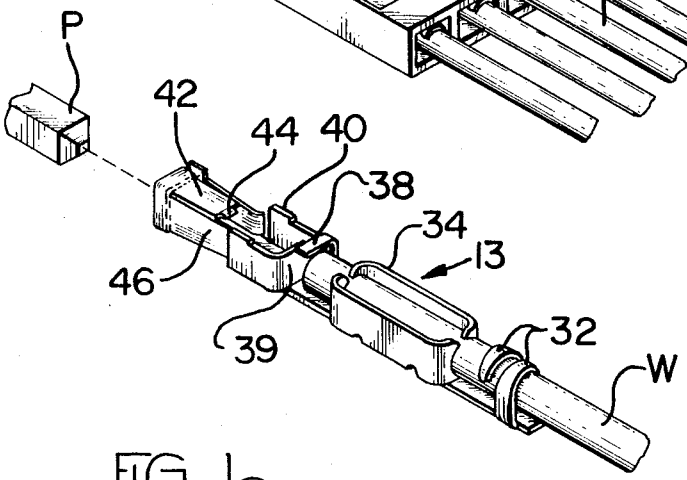
FIG. 1*c* is an enlarged perspective view of one of the terminals as shown in FIGS. 1*a* and 1*b* terminated to an electrical wire conductor.

Each of the terminals includes a wire strain relief portion comprised of thin and crimpable tabs 32 in FIG. 1*a* and a termination portion in the form of an insulation displacement portion 34 having terminating slots at each end thereof which penetrate the insulation of conductive wires and provide a reliable, permanent electrical connection between terminals 13 and the wires. Ahead of the portion 34 are further tabs 38 and 39 formed of the terminal stock. The tab 38 which is vertically upstanding and is made to be relatively deformable as by crimping, serves to bear against the end edge of the rear of the connector housing 12 as shown in FIG. 1*a* to preclude movement of the terminal further into the housing and forms part of a latching mechanism, so as to maintain the terminal array in the housing. Tab 38 subsequently is folded over at right angles to the longitudinal axis of the terminal while tab 39 acts as a wire stop precluding the wire or portions thereof from projecting forwardly into the contact spring elements of the terminal as is shown in FIG. 1*c*. FIG. 1*c* best reveals projections 40 which are dimensioned relative to the base of the box-like terminal structure to secure the terminal within the interior of the passage 16 of housing 12 against rotation or up and down movement, the width of the box-like structure working similarly to preclude the terminal from sideways movement within the passage of the housing. Just forward of projections 40 on the top of terminal 13 is a spring element 42 having detent 44 biased upwardly and dimensioned to latch into the apertures 14 when the terminals are positioned as shown in FIG. 1*a* and further, into apertures 16 when the terminals are fully inserted as is depicted in FIG. 1*b*. As can be appreciated, with the terminal strip inserted and the detents 44 in place in the passage 16, the tabs 38 preclude forward movement of the terminal strip to the housing and the detents preclude rearward movement to thus latch terminal strip relative to the housing for handling of the assembly of housings and terminal strips prior to use.

Included in the box-like structure of terminal 13 in the forward end, is a contact spring 46 struck from the sides of the contact terminal material which mate with posts inserted within the terminal to effect an interconnection to the conductive wires W in FIG. 1*c*, a typical post being shown as P in 1*c* prior to such interconnection.

Referring now back to FIG. 1*b*, the center-to-center spacing of passages 16 of the housing 12 and thus of the terminals as mounted therein is the same distance D as shown in FIG. 1*b*. This spacing is held for common points along the width of the housing, except relative to the leading edge and trailing edge 17 and 23 in FIG. 1*a*. This reference is made relative to the movement of the connector in accordance with the method and machinery hereinafter to be described, such movement being shown by the arrow in FIG. 1*a*. As can be discerned, the leading top edge 17 includes a housing dimension LE and the trailing top edge 17 includes a dimension TE, both of these dimensions being different from similar top surfaces of the housing in between such apertures 14 and 15. In an exemplary reference to dimensions LE and TE in an actual connector considering that the center-to-center spacing D was on the order of 100 units, the dimension LE was 10 units and the dimension TE was 40 units. This dimensioning is necessary to provide adequate housing material thickness, while at the same time permitting molding techniques for manufacture of the housings. As can be appreciated, this variation in dimension means that indexing the connector assembly presents varying dimensions to any sort of feed mechanism utilizing the detent apertures 15. Furthermore, when it is realized that the housings such as 12 may come in positions ranging from 2 to 30, with the positions varying from connector to connector during the same processing operation such as a stream of connectors having 2, 4, 2, 6, 8, 10 or some other multiple of positions, the background problem heretofore set forth can perhaps better be appreciated. Additionally, the design problem required that housings like 12 having at least two stylings be accommodated, the principle difference being the length of the housing 12 or the characterization of projections above or beneath of the housings utilized for interconnecting with other housings or latching the housings to other connectors.

In summary, a family of connectors having two styles of housings and multiple positions is contemplated, wherein the housings contain terminals attached to the terminal carrier strips in a partially assembled condition. The assembly of housing and terminals is fed through the machine of the invention to be loaded with conductor wires placed into the terminals and terminated thereto, with certain portions of the terminals deformed and the terminals and carrier strips displaced relative to the housings to insert such terminals within the housings, with the carrier strips being bent by the machine to allow ease of removal of the carrier strips following termination and insertion. Further, the terminals latch themselves into the housings during insertion and all of these functions are carried out with the terminals being maintained on centers to tolerances as stamped rather than in some other loose piece or form which has a much wider tolerance.

Figure 2:
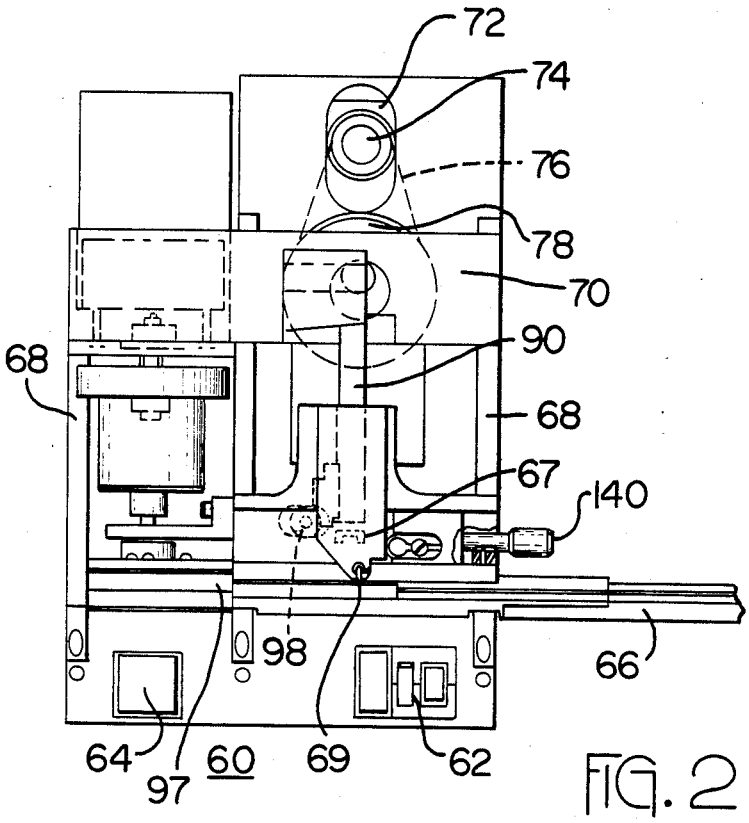
FIG. 2 is a front elevational view of the machine of the invention showing the general arrangement of motor, drives loading guide track and details useful in understanding the invention.
Figure 6:
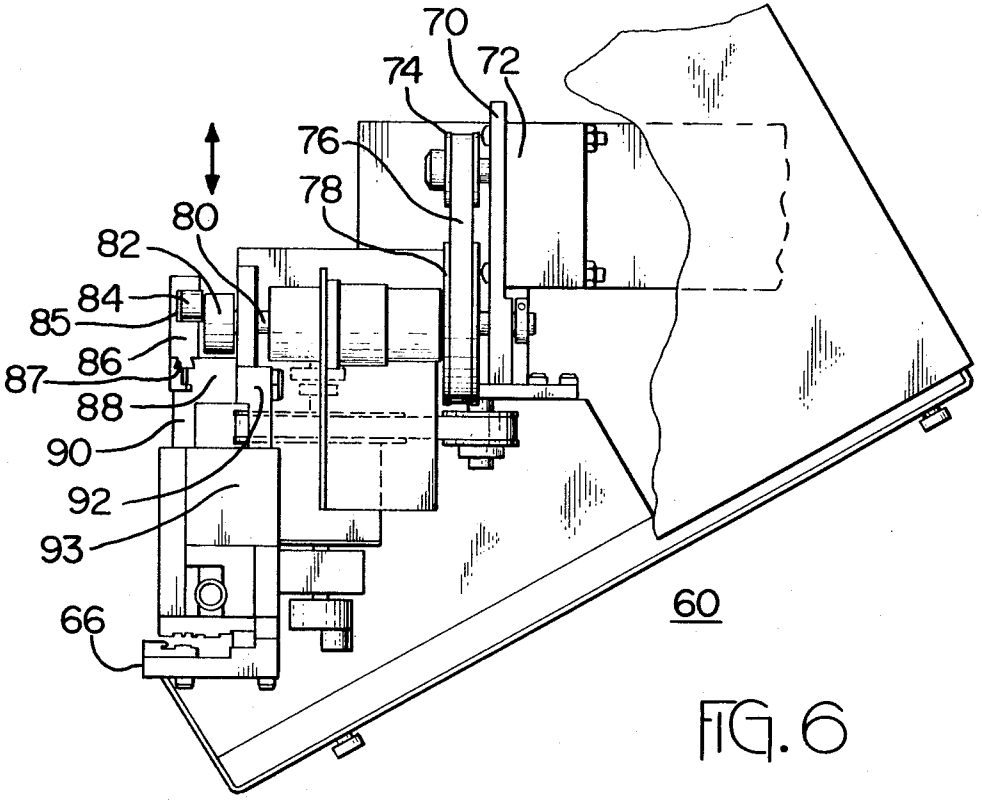
FIG. 6 is a view of the machine of the invention taken from the right side thereof relative to the view shown in FIG. 2.

FIG. 2 shows the machine 60 as viewed from the front face with the view depicting the machine tilted to make the mechanisms oriented to travel in the plane of the paper. Figure 6 should now be referred to to understand that in fact the machine is carried at an angle of roughly 60 degrees relative to the horizontal in terms of such motions. In FIGS. 2 and 6, control buttons 62 can be seen for the two distinct machine halves, the buttons 62 operating functions of the right-hand portion of the machine which is the indexing and terminating and crimping portion, and the button 64 operating in part the functions of the left-hand portion of machine 60 which serves to fully load the terminals within housings and effect the bending of the carrier strip as heretofore described. The two portions of the machine could indeed be separate machines, but that would necessitate that the housings be carried from one machine to the next, reloaded and so on.

Referring again to FIGS. 2 and 6, a guide track 66 is shown which accommodates the connector terminal assemblies in a form as depicted in FIG. 1*a*, the track 66 having interior dimensions which hold the housings therein for displacement from right to left. The length of track shown in FIG. 2 is intended to accommodate a supply of housings such as twenty or thirty which may be arranged in a sequence of positions in accordance with production needs or some subsequent sequence of processing. Alternatively, and not shown, cartridges containing housings having preassembled terminals therein may be provided and fitted to track 66 or even further, alternatively reels of such product may be provided and arranged on track 66.

As is further shown in FIG. 2 toward the center thereof, a plate 67 is fixed against movement to the frame of the machine and includes in the lower portion a wire guide and slot structure 69 which permits an operator to insert a wire to be terminated in an aligned position relative to an indexed connector and terminating and crimping tooling driven up and down in machine 60. This tooling is shown in phantom behind plate 67. Machine 60 may be seen to have a frame including sidewalls 68 to which are bolted a number of plates including 70 in turn carrying the driving and driven mechanisms of the machine. As can be seen in FIGS. 2 and 6, the plate 70 has mounted thereon a motor 72, which is typically an electric motor arranged to drive a pulley 74 in turn, driving a belt 76, a further pulley 78 locked to a shaft 80 through appropriate gear reduction which carries cam driver 82 having an eccentric cam 84 mounted thereon. Cam 84 is fitted within a slot 85 within sliding block 86 which is secured to a ram structure 88. As the motor 72 is driven to rotate, the drive rotates with cam 84 moving within slot 85 as cam 84 drives the block 86 downwardly and upwardly along the axis shown by the arrow in FIGS. 2 and 6. Referring to FIG. 6, the block 86 is suitably keyed as at 87 to the ram drive structure 88 for ease of assembly, and the ram drive is connected to two rams 90 and 92, suitably supported for sliding movement within the structure 93 secured to the frame of the machine.

Figure 3:
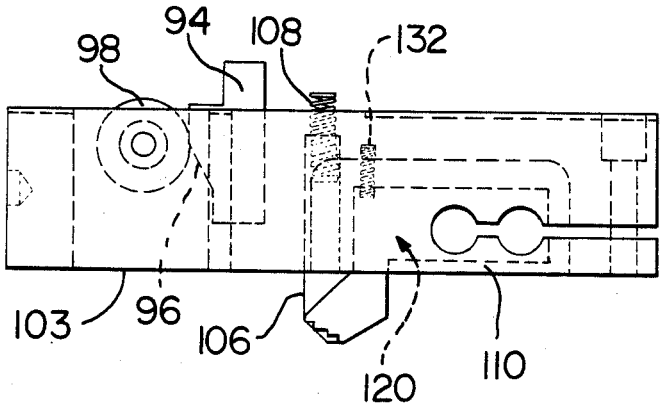
FIG. 3 is a front elevational view of the feed slide mechanism of the machine showing details relative to the pawl feed finger which effects indexing of connector housings.
Figure 4:
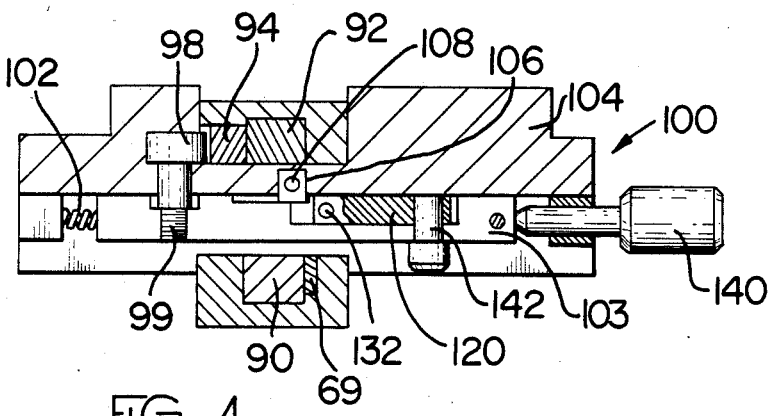
FIG. 4 is a top plan view, partially sectioned, of the feed slide mechanism shown in FIG. 3.
Figure 5:
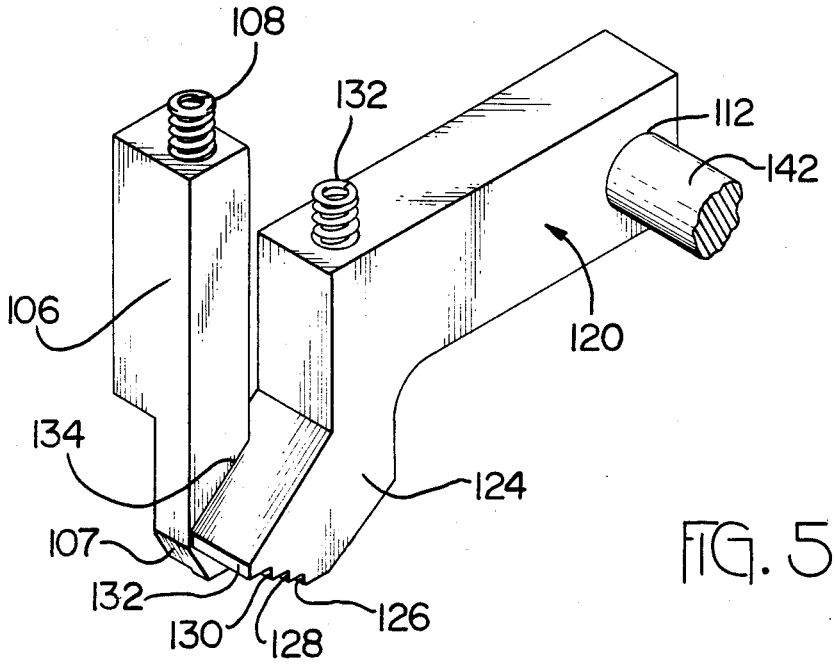
FIG. 5 is a perspective view of the detent and pawl feed finger mechanism of the invention somewhat enlarged from that shown in FIGS. 3 and 4.

As can be best seen in FIG. 2, the ram 92 includes a cam element 94 positioned to engage and displace a cam follower 98 to the left. This follower 98 is mounted in a slide feed assembly 100 more particularly shown in FIG. 4. The slide feed assembly 100 is fixed within the right-hand lower portion of the machine 60 as can be discerned by comparing FIGS. 3 and 4 with FIG. 2. The feed slide member 103 can be particularly viewed in FIG. 3. It is connected to cam follower 98 by a screw 99 to be driven back and forth by such cam follower, a compression spring element 102 serving to provide the return movement, the feed slide member 103 is fixed against vertical movement within the assembly 100, the limits of horizontal movement being established by the cam follower and slide feed adjustment screw 140 shown in FIGS. 2 and 4. Block 104 is the mounting for the slide feed as shown in FIG. 4 and wire guide 69 is mounted in block 93 as also shown in FIG. 4. The ram 90 which contains the terminal stuffing termination and crimping tooling can be seen in FIG. 4, along with a portion of the rear ram 92, along with the rear ram 92. Toward the center of the slide feed assembly 100 is a detent element 106 which is spring loaded by spring 108 downwardly to engage the apertures 15 in housing 12 heretofore discussed relative to FIGS. 1*a* and 1*b*. FIG. 5 shows the nose 107 of the detent element 106 as beveled and the detent element is confined for vertical movement in the block 104 of the slide feed assembly 100.

Trapped behind the slide feed member 103 is a pawl structure shown as slide feed finger 120 in FIGS. 4 and 5. The finger 120 is pivotally mounted to the slide feed member 103 by a screw 142 having an eccentric fitted into an aperture 112 of the feed finger 120 as shown in FIGS. 4 and 5. By rotation of the screw 142, the feed finger 120 may be adjusted toward or away from the detent element 106. A spring 132 shown in FIGS. 3 and 4 biases the feed finger 120 downwardly in the position shown in FIG. 3.

FIG. 5 shows an enlarged view of the feed finger 120 in association with the detent element 106 and the relationship of the feed finger 120, the spring 132 for feed finger 120 and spring 108 for the detent element 106. As can be seen particularly in FIG. 5, the feed finger 120 has a lower projection 124 which ends in a series of step surfaces 126, 128, 130 and 132, which variously engage surfaces on the housings indexed by the feed finger 120 in its horizontal movement. The lower projection 124 of the feed finger 120 is relieved as at 134 to allow an internesting of the detent element 106 so that it lines up with the step surfaces 126–132.

Referring now to the operation of the apparatus of the invention, a series of connectors are loaded into track 66 and moved to the left manually until the leading edge, referencing FIG. 1*a*of the connector housing, strikes the tapered end of detent element 106, the assembly being positioned in the guide track so that the end of the detent element is aligned with the forward apertures 15 of housing 12. At this point in time, the ram 92 associated with the feed finger 120 will be in the upward position, slide feed member 103 and feed finger 120 will be biased to the right. In accordance with procedures for the apparatus, the operator will cycle the apparatus to force the housing to the left in the track 66 until the detent element 106 rides over the edge LE and nests within the first aperture 15, being forced downwardly by spring 108 to lock the housing in a proper position. At this point in time, the operator will insert an unstripped lead wire through wire guide 69 so that it overlies the first terminal 13 of the connector, that terminal associated with first aperture 15. With the lead so positioned, the motor 72 may be cycled through the energization of an appropriate circuit such as a solenoid to drive the rams 90 and 92 downwardly. Ram 90 carries at the end thereof, tooling of a configuration to deform the terminal as shown in FIG. 1*c*. This tooling includes a crimping die shaped to crimp the tab 38 downwardly from the position shown in FIG. 1*a* to the position shown in FIG. 1*c*. This die further includes a stuffer which will stuff the wire into the insulation displacement portion 34 heretofore discussed, to terminate the wire and crimp the tabs 32 around the wire insulation to provide strain relief. Interiorly of the crimping tool area is the tab 39 lined up with projection 38 in a vertical sense which causes the end of the wire to rest against 39 following termination and crimping. The ram returns to the up position at this part of the cycle with the slide feed member 103 returning to the right.

In accordance with this invention, the displacement of the feed finger 120 is relatively fixed for each machine cycle. In the description here given, surface 128 of the feed finger would find surface B of the second aperture 15 and be biased into engagement therewith by the spring element 132 which pushes the feed finger downwardly.

Referring back to the cycle just described, as the ram 92 descends during the cycle just described actuating the cam element 94, the tapered surface 96 thereof drives the cam follower 98 to the left thereby driving the feed slide member 103 to the left and in turn, driving the feed finger 120 to the left with the surface 128 driving the housing 12 to the left, detent element 106 being biased upwardly to ride along the housing surface until the end of the machine stroke, whereupon the detent element is lodged within an appropriate aperture 15. At this time the ram 92 continues on its downward travel with no further displacement of the cam follower 98 which is riding upon the flat area of the cam element 94. Ram 90, the forward ram, carrying the termination and crimping tooling, progresses as described downwardly to stuff the conductor wire into the termination portion of the next terminal, deform elements 32 and 38 to effect a termination and crimping action, with the ram then returning upwardly as cam driver 82 rotates and as the eccentric cam 84 cams block 86 upwardly. At this point in the cycle, the feed finger 120 will be again positioned to the right driven by the feed slide member 103, itself driven by the compression spring 102 to the end of its travel against the adjustment post 140. The end of the feed finger 120 will be biased downwardly by the spring 132 so that one of the surfaces 126–132 will engage an appropriate surface of the housing, in this case, a surface one unit away from the previous location which in the present instance would be surface C of an aperture 15. This operation would then continue until the housing was completely terminated and until the feed finger, one of its surfaces, reach the trailing edge or surface E should there be no connector following the connector just completed. Alternatively, the under surface 126 of the feed finger will engage surface A of the next connector proximate to the leading edge LE of the next connector. In this way, the feed finger arrangement of the apparatus of the invention accommodates the varying dimensions associated with feeding housings which have different numbers of positions and different indexing surfaces thereon. Relative to the family of connectors of the type shown in FIGS. 1*a*–1*c*, the two surfaces 126 and 128 will suffice. The remaining surfaces 130 and 132 are used for a similar type of connector but one having different surfaces A–E than those represented, in dimensional terms.

With the last terminal terminated and crimped, the connector housing will be free of detent element 106 and the operator will then, utilizing the crimped conductor wires, slide the terminated assembly along the track 66 to the next station or the left-handed portion as viewed in FIG. 2 of the machine 60 of the invention. As can be discerned from FIG. 2, the track 66 is accommodated by a fixed guide portion 97 which is relatively broad or wide and does not require the assembly to be precisely positioned. Again, referencing FIG. 2, the assembly can be positioned in the general vicinity of the center line of the guide 97 or as more particularly shown in FIGS. 8*a* and 8*b*, looking down upon the assembly, or of FIG. 9*a* looking in from the left of the assembly referencing FIG. 2.

Figure 7:
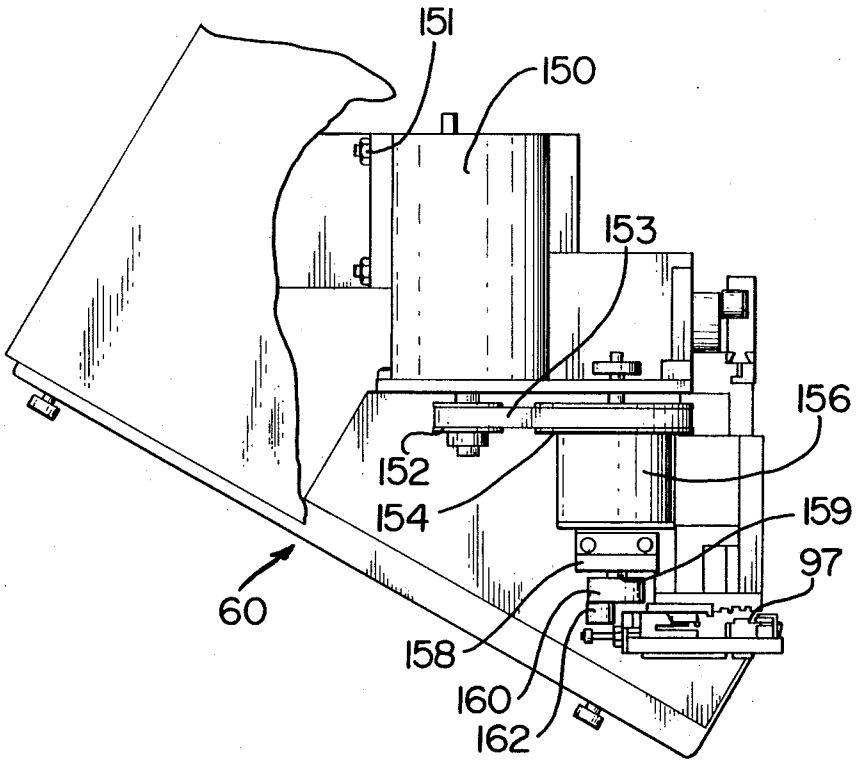
FIG. 7 is a view of the machine of the invention taken from the left side thereof relative to the view shown in FIG. 2.
Figure 8B:
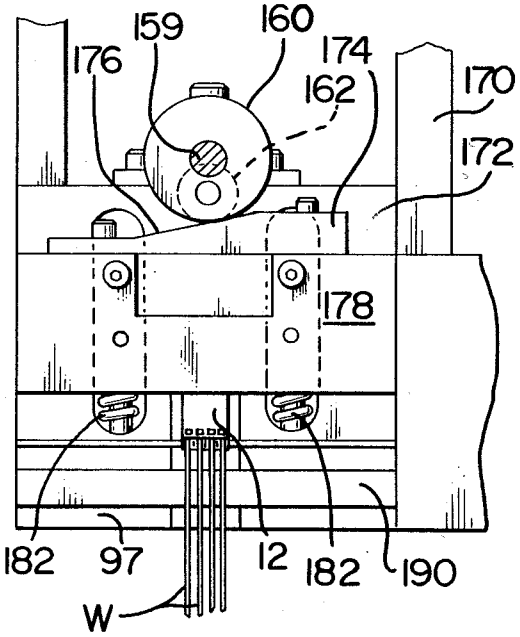
FIG. 8*b* is a showing of the mechanism of FIG. 8*a* following terminal loading.
Figure 8A:
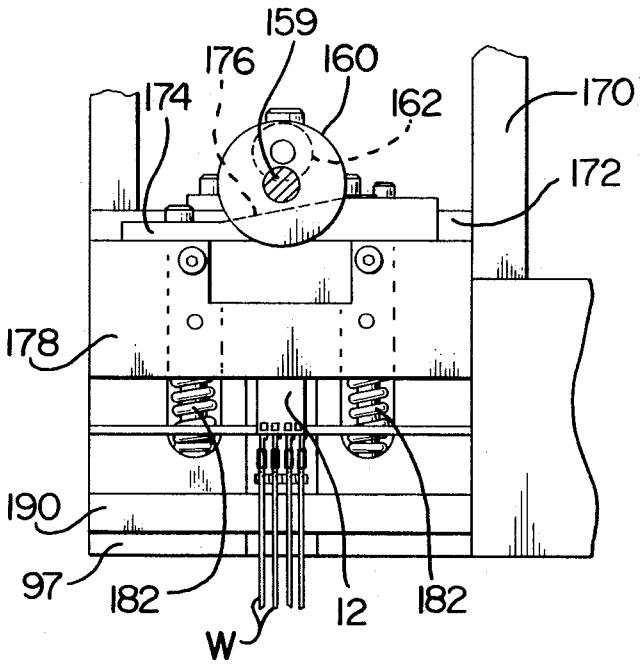
FIG. 8*a* is a part plan view looking down on the connector housing loading and bending mechanism in an initial position prior to terminal loading into a housing, this mechanism being shown to the left in FIG. 2.
Figure 9A:
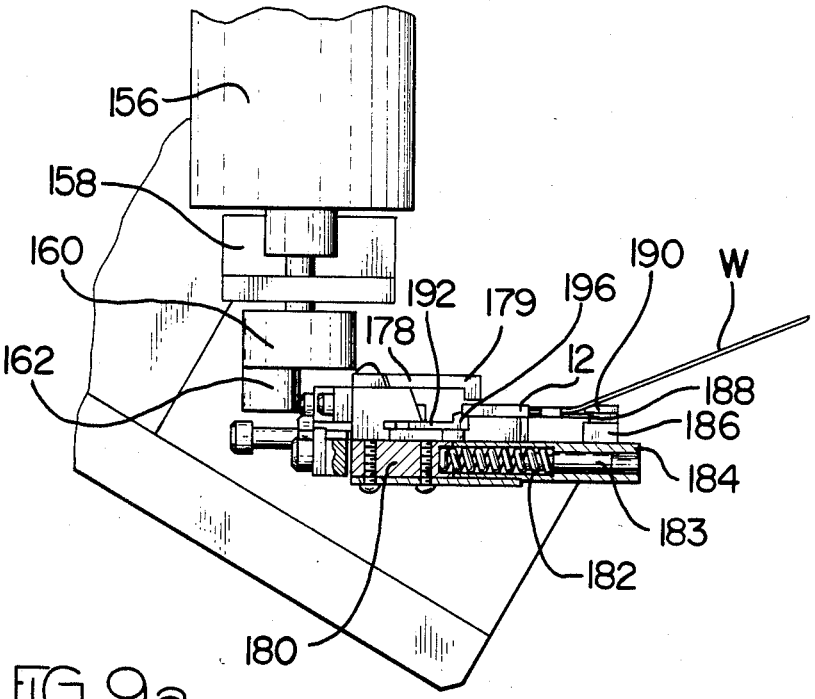
FIG. 9*a* is a side and elevational view in partial section of the mechanism shown in FIG. 8*a*.

In FIG. 7, the left-handed portion of the apparatus 60 may be seen to include a motor 150 suitably mounted to the frame of the assembly by bolts 151. Motor 150 drives a pulley 152, a belt 153 which in turn drives a pulley 154 of gear reduction drive 156, which is secured as by a bracket 158 as shown in FIG. 7. The shaft 159 which is an output from gear reduction drive 156, carries an eccentric assembly 160 having an eccentric cam 162 thereon. The lower portion of the apparatus is fixed to the frame element 170 including the guide track portion 97 as shown in FIGS. 2, 8*a* and 8*b*. Upon this lower portion, there is provided a movable assembly which includes a cross-plate 172 carrying a cam block 174 having a cam surface 176 thereon and adapted to be driven in movement toward the guide track assembly 97. There is provided a plate 178 as shown in FIGS. 8*a* and 9*a* which has a projection 179 which limits the movement of the connector housing in a vertical sense. As viewed in FIG. 9*a*, the lower movable portion of the assembly includes a block element 180 which is driven to the left as shown in FIG. 9*a* by a set of compression springs 182 captured between the right edge of 180 and a guide pin 183 secured to the fixed guide support structure 184. This fixed portion includes a block spacer 186 carrying the outboard portion of the feed track including particularly a member 188 as shown in FIG. 9*a* which engages the end of the carrier strips 26 and 27, referencing FIG. 1*a*. A cap plate 190 covers the carrier strip at this point to prevent its upward vertical movement. The cap plate 190 includes the beveled surface 191 over which the wires W are laid for sliding movement therealong when the connector is in the left-handed portion of the apparatus.

To the left of the connector as shown in FIG. 9*a* is a plate 192 which has a projection including a projection 196 which catches the forward end of the connector housing 12 and confines such against movement inwardly of the apparatus. Plate 192 is mounted to the movable block 180, and driven by the cam 162 disposed on cam block 174 as shown in FIG. 8*a*.

Figure 9B:
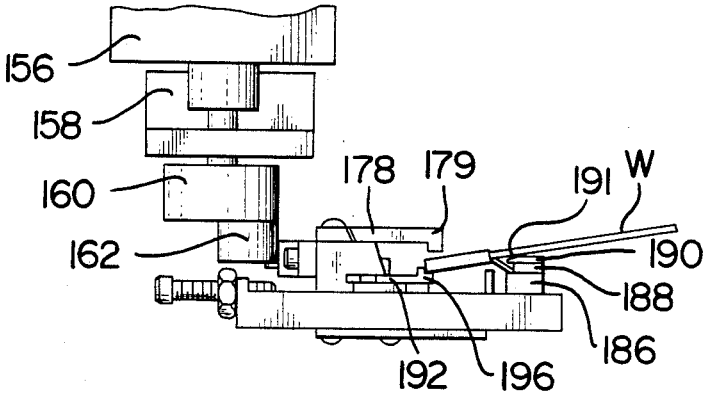
FIG. 9*b* is a side elevation and partially sectioned view of the mechanism of FIG. 8*b*.

Viewing now the operation of the apparatus in the terminal insertion and carrier strip bending function, reference is made to FIGS. 8*a*, 8*b*, and 9*a* and 9*b*. In FIGS. 8*a* and 9*a*, the connector is shown in an initial position as placed by an operator following termination with the conductor wires guided over plate 190 as shown in FIG. 8*a* and with the motor and drive mechanisms in an initial precycle condition as referenced by the position of cam 162 as shown in FIGS. 8*a* and 9*a*. Upon the initiation of the cycle as by a foot switch interconnected to the motor through a solenoid or in the event of the use of a stepping motor through an electronic power supply, assembly 160 is driven to rotate, carrying the eccentric cam 162 around to engage the cam surface 176, driving such to the right as shown in FIG. 9*b* or downwardly as shown in FIG. 8*b* against the compression of springs 182. As this occurs, the ends of the carrier strip engage member 188 and the housing 12 is driven by projection 196 to the right as shown in FIG. 9*a* until the terminals are loaded with the detents 44 snapping into the apertures 15 associated with housing 12, referencing FIGS. 1*a* and 1*b*. The connector will now be in the condition shown in FIG. 1*b* with the terminals seated within the housing and latched therein. In accordance with the invention, however, movement continues in this cycle until the connector is in the position shown in FIG. 9*b*, so that a force is generated which buckles and bends the carrier strips downwardly at or around, the score lines S, previously described in reference to FIG. 1*a*. The cycle continues with the eccentric cam 162 rotated back to the initial position as shown in FIG. 8*a* and in FIG. 9*a*, with the operator then removing the connector having the carrier strip bent as shown in FIG. 9*b*. Thereafter, the operator can inspect the assembly and remove the carrier strip merely by bending it more toward 90 degrees relative to the insertion axis of the connector.

According to the foregoing, multiple connectors of different styles and different numbers of positions may be accommodated without essential changes in the apparatus, one set-up is accomplished. The right portion of machine 60 and the left portion will operate to allow termination, assure indexing and loading of terminals and bending of the carrier strips of connectors of different dimensions.

We claim:

1. Apparatus for making an electrical connector assembly, where said assembly comprises a housing containing terminals to which conductors are terminated in a family of connectors with each member of the family having a different number of terminal positions and said housing having a series of indexing surfaces thereon to provide indexing of said connectors along a path in said apparatus, wherein said indexing surfaces have at least two different spacings, the combination comprising:

a. track means for guiding connectors for movement in said apparatus with the said indexing surfaces traveling along a given axis, b. detent means including a detent operable to engage housing indexing surfaces to hold a connector in a given position in said track means against rearward movement, c. means for limiting the movement of said housing in a vertical sense, d. terminating means positioned relative to said indexing surfaces to terminate a conductor wire to a terminal in a given connector, e. feed means adapted to engage the said indexing surfaces on each housing to move the connectors forwardly and into engagement with the said detent means to position the connectors relative to the terminating means, the said feed means including at least two drive surfaces spaced apart relative to housing movement in said track means and driven so that one drive surface engages an appropriate indexing surface to drive the housing in said movement, and f. drive means to drive said feed means in a constant displacement cycle to effect said movement.

2. The apparatus of claim 1 wherein said indexing surfaces of said housings have more than two spacings differing each from the other within the family of connectors and said feed means including one surface for each of said housing indexing surfaces.

3. The apparatus of claim 1 wherein said feed means includes a series of steps defining a series of drive surfaces and means to bias said drive surfaces transversely to ride over the said housings whereby one of said drive surfaces engages one of said housing indexing surfaces at the end of said displacement cycle.

4. The apparatus of claim 1 wherein said feed means includes a pawl adapted to be driven to and fro along the said given axis with said pawl carrying on an end thereof a series of steps oriented perpendicularly to said given axis to define said drive surfaces.

5. The apparatus of claim 1 wherein said drive means includes means limiting travel thereof to a fixed displacement to and fro along said given axis to drive said feed finger at said drive surfaces in a cycle of fixed displacement.

6. The apparatus of claim 5 wherein said feed finger includes more than two drive surfaces.

7. An application tool for terminating conductor wires to electrical terminals mounted in plastic housings characterized in that there is a family of connectors having different numbers of terminals in housings of different sizes but with each housing having a series of vertical surfaces, the center-to-center spacing of which is in accordance with a given set of distances, means to guide the said housings in a relatively horizontal sense, means to index said housings including a feed finger and means to drive said finger in a constant displacement to and fro along said guide means, the said feed finger including a set of surfaces appropriate to the said set of distances whereby to engage one of said housing surfaces and index said housings in constant displacement steps along said guide means, indexing means adapted to engage said housings through contact with said surfaces to hold said housings fixed during movement of said feed finger means, and terminating means adapted to terminate conductor wires into said terminals, said terminating means being aligned with said indexing means.

8. An apparatus for making an electrical connector assembly, which includes terminating conductor wires to terminals in a connector housing characterized in that the housing includes a series of vertical drive surfaces having a variety of center-to-center spacings and in that the housings are pre-loaded with terminals partially inserted into such housings, said apparatus comprising:

a. guide track means for guiding said connectors along a horizontal path beneath a terminating station, b. indexing means including a feed finger biased transversely to said horizontal path, said finger containing a series of vertical surfaces, one for each of said vertical drive surfaces of said housing, c. drive means to activate said indexing means to cause said feed finger to engage said housing vertical drive surfaces sequentially and drive said housing in a fixed displacement along said horizontal path, and d. terminating means positioned to terminate a conductor wire in said terminal sequentially following each said displacement.

* * * * *